US005592931A

United States Patent [19]

Johnson et al.

[11] Patent Number: 5,592,931

[45] Date of Patent: Jan. 14, 1997

[54] COMPRESSED AIR GUN WITH MAGAZINE INDEXER

[75] Inventors: Lonnie G. Johnson, Smyrna; John Applewhite, Atlanta, both of Ga.

[73] Assignee: Johnson Research & Development Co, Inc., Smyrna, Ga.

[21] Appl. No.: 494,407

[22] Filed: Jun. 26, 1995

Related U.S. Application Data

[63] Continuation-in-part of Ser. No. 441,229, May 15, 1995.

[51] Int. Cl.[6] ..... F41B 11/00

[52] U.S. Cl. ..... 124/69; 124/72; 124/53.5; 124/48; 124/63; 446/27

[58] Field of Search ..... 124/72, 63, 69, 124/53.5, 48, 59; 446/27, 475; 273/DIG. 17

[56] References Cited

U.S. PATENT DOCUMENTS

| | | | |
|---|---|---|---|
| 2,147,003 | 2/1939 | Kozurik | 124/72 |
| 2,312,244 | 2/1943 | Feltman | 124/72 |
| 2,357,951 | 9/1944 | Hale | 124/72 |
| 2,654,973 | 10/1953 | Lemelson | 446/27 |
| 2,733,699 | 2/1956 | Krinsky | 124/13 |
| 2,927,398 | 3/1960 | Kaye et al. | 46/74 |
| 3,025,633 | 3/1962 | Kaye et al. | 46/74 |
| 3,049,832 | 8/1962 | Joffe | 46/74 |
| 3,121,292 | 2/1964 | Butler et al. | 46/74 |
| 3,397,476 | 8/1968 | Weber | 124/72 X |
| 3,962,818 | 6/1976 | Pippin, Jr. | 46/74 |
| 4,073,280 | 2/1978 | Koehn et al. | 124/72 |
| 4,083,349 | 4/1978 | Clifford | 124/72 |
| 4,159,705 | 7/1979 | Jacoby | 124/63 |
| 4,223,472 | 9/1980 | Fekete et al. | 46/44 |
| 4,411,249 | 10/1983 | Fogarty et al. | 124/64 |
| 4,890,767 | 1/1990 | Burlison | 446/27 X |
| 4,897,065 | 1/1990 | Fertig et al. | 446/63 |
| 5,090,708 | 2/1992 | Gerlitz et al. | 273/DIG. 17 |
| 5,188,557 | 2/1993 | Brown | 446/52 |
| 5,280,917 | 1/1994 | Ortiz | 446/27 X |
| 5,343,849 | 9/1994 | Steer | 124/69 X |
| 5,343,850 | 9/1994 | Steer | 124/59 X |
| 5,370,278 | 12/1994 | Raynie | 446/27 X |
| 5,373,832 | 12/1994 | D'Andrade | 124/59 X |
| 5,415,152 | 5/1995 | Adamson et al. | 124/59 |

*Primary Examiner*—Randolph A. Reese
*Assistant Examiner*—Thomas A. Beach
*Attorney, Agent, or Firm*—Kennedy & Kennedy

[57] ABSTRACT

An air compressed gun (70) is provided having a housing (71), a magazine (75) having multiple barrels (89) for holding projectiles, and a manual air pump (76). The gun also has a pneumatic indexer (82) which indexes the magazine for firing with each shot of the gun and a harness (77) which enables the magazine to be supported adjacent the head of a person.

16 Claims, 6 Drawing Sheets

COMPRESSED AIR GUN WITH MAGAZINE INDEXER

REFERENCE TO RELATED APPLICATION

This is a continuation-in-part of Application Serial No. 08/441,229 filed May 15, 1995.

TECHNICAL FIELD

This invention relates to compressed air guns, and specifically to compressed air toy guns having a multi-projectile magazine and an indexer for sequentially positioning the magazine for firing.

BACKGROUND OF THE INVENTION

Toy guns which shoot or launch projectiles have been very popular for many years. These guns have been designed to launch projectiles in a number of ways. A common method of launching has been by the compression of a spring which propels the projectile upon its decompression or release, as, for example, with BB guns and dart guns. These guns however usually do not generate enough force to launch projectiles with great velocity.

Toy guns have also been designed which use compressed air to launch projectiles such as foam darts. These types of guns use a reciprocating air pump to pressurize air within a pressure tank. In use, a single dart is loaded and the pump is typically reciprocated several times with each firing of the gun. Therefore, the gun must be loaded and pumped with each firing as it is not capable of firing several darts in rapid sequence. The rapid firing of a gun may be desired for those playing a mock war or other type of competition.

As children often become bored with the design of conventional guns it is desirous to design guns having an unconventional construction or appearance. However, unconventional guns are often difficult to accurately aim and fire.

Accordingly, it is seen that a need remains for a toy air gun which may rapidly fire a sequence of projectiles. Also, it is seen that a need remains for a toy air gun of an unconventional design which may be accurately aimed and fired. It is to the provision of such therefore that the present invention is primarily directed.

SUMMARY OF THE INVENTION

In a preferred form of the invention a rapid fire compressed air gun has a magazine in which a plurality of projectiles may be loaded, a pressure tank, and pump means for compressing air in the pressure tank. The gun has pneumatic indexing means for sequentially positioning projectiles in the magazine for firing, conduit means for conveying compressed air from the pressure tank to the magazine, and trigger means for controlling the flow of air from the pressure tank to the magazine and the pneumatic indexing means in launching the projectiles. So constructed, the gun may automatically index the magazine for rapidly firing projectiles in sequence.

In another preferred form of the invention a compressed air toy gun for firing projectiles comprises launch tube means for holding, aiming and launching projectiles, head harness means for supporting the launch tube means adjacent the head of a person, hand pump means for manually compressing air, and flexible conduit means for conveying compressed air from the hand pump means to the launch tube means. With this construction, the hand pump means is manipulated by the person and oriented substantially independently of and without effecting the aim of the launch tube means.

In yet another preferred form of the invention a compressed air toy gun comprises a magazine in which a plurality of projectiles may be loaded, pump means for compressing air, and pneumatic indexing means for sequentially positioning projectiles in the magazine for firing. The gun also includes triggering means for sequentially triggering the release of compressed air to the magazine for firing the projectiles and means for conveying compressed air from the pump means to the pneumatic indexing means and to the magazine in both sequentially positioning and firing the projectiles.

DETAILED DESCRIPTION

Figure 1:
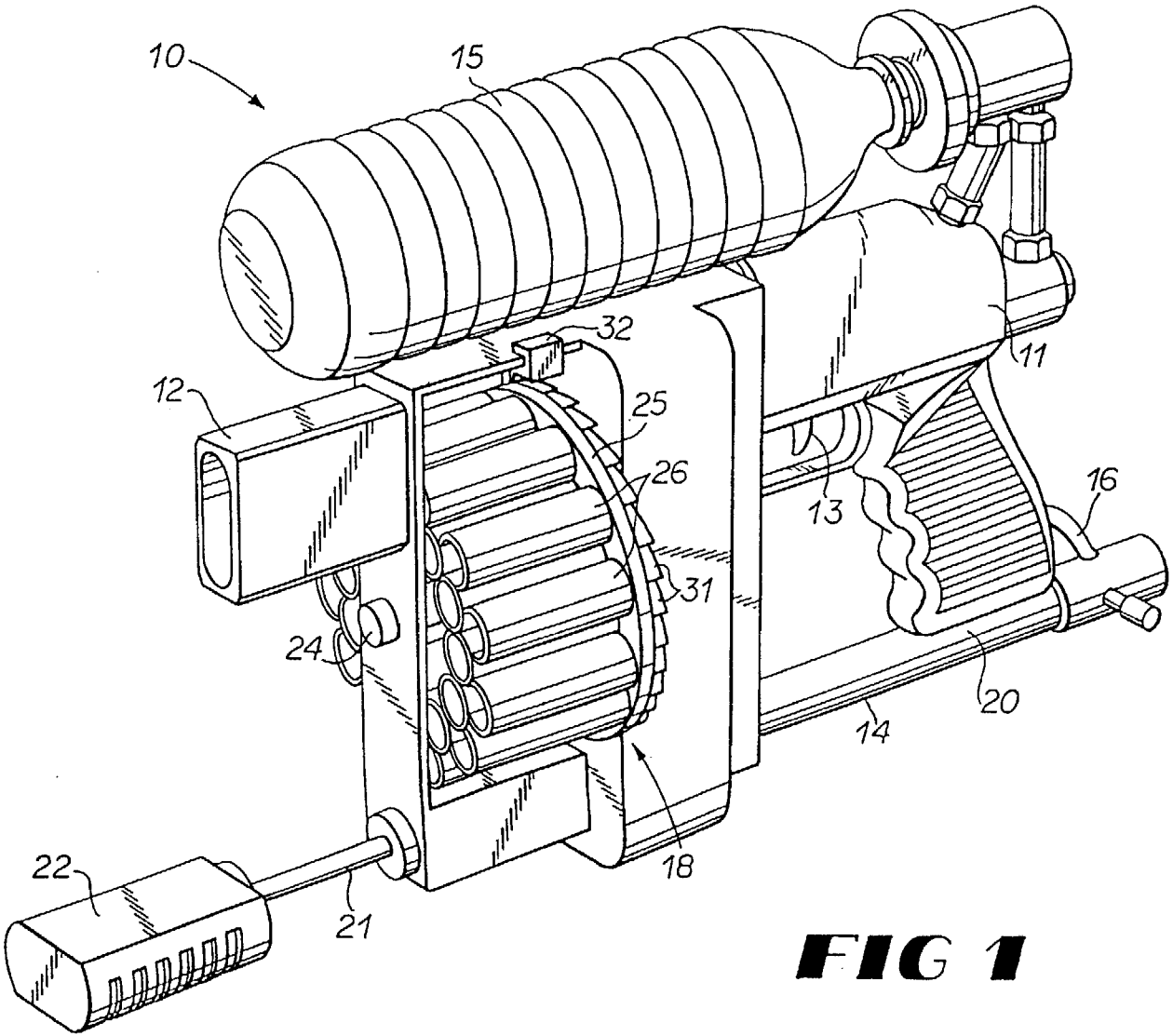
FIG. 1 is a perspective view of a rapid fire compressed air gun embodying principles of the present invention in a preferred form.

With reference next to the drawings, there is shown a compressed air gun 10 having a stock or handle 11, a barrel 12 mounted to the stock 11, a spring biased trigger 13, and a manual air pump 14. The gun 10 has a pressure tank 15 in fluid communication with the air pump 14 through a pressure tube 16 and a multi-projectile magazine 18 rotationally mounted to stock 11. The pump 14 includes a conventional cylinder 20, a cylinder rod 21 and a handle 22 mounted to an end of the cylinder rod 21.

Figure 2:
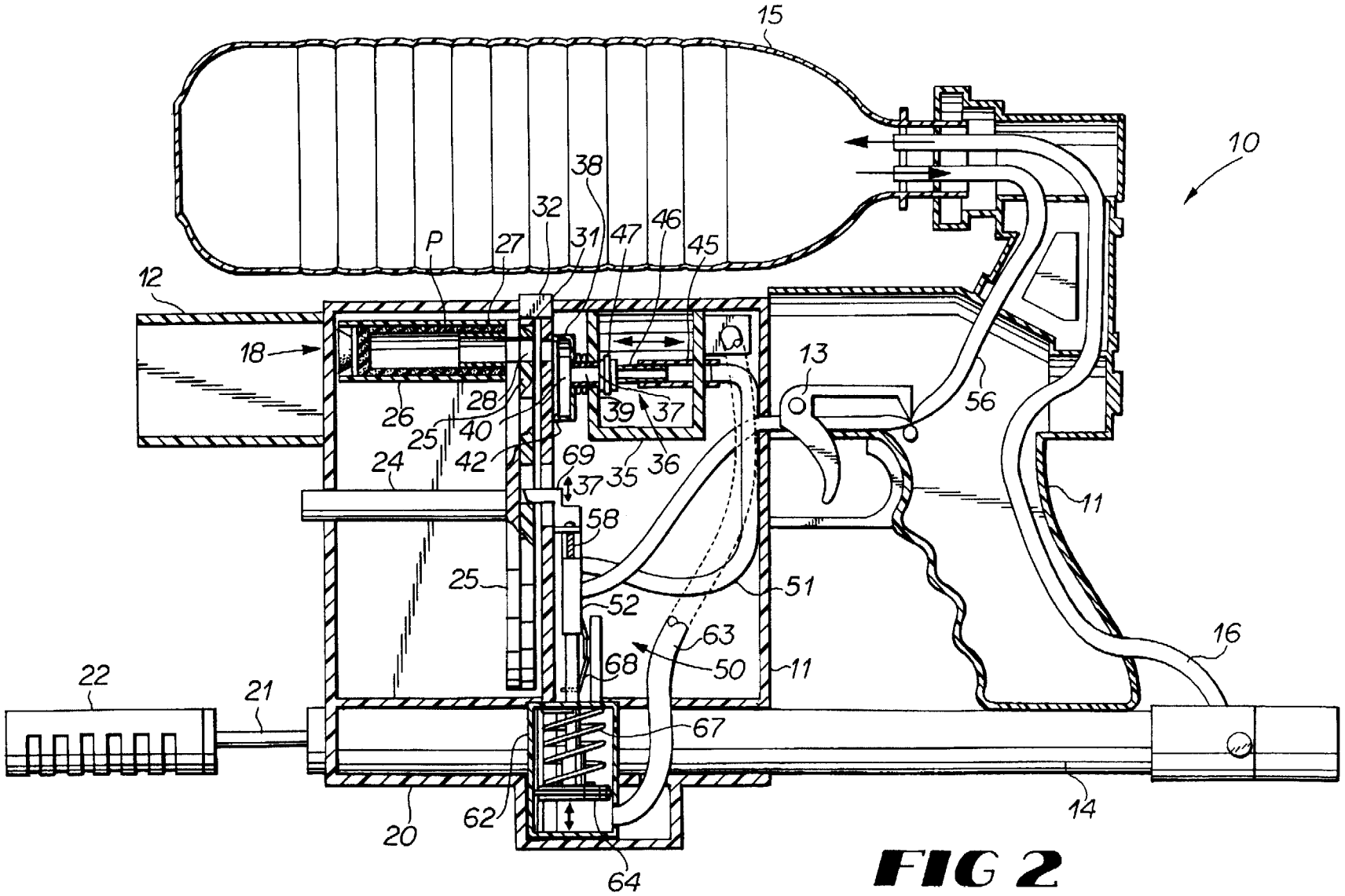
FIG. 2 is a side view, shown in partial cross-section, of the air gun of FIG. 1.

The magazine 18 has a central pivot rod 24 mounted to a disk-shaped mounting plate 25 and an annular array of projectile barrels 26 extending from the mounting plate 25 in generally two concentric circles about pivot rod 24. Each barrel 26 has a launch tube 27 therein aligned with an opening 28 extending through the mounting plate 25. The gun magazine is shown in FIG. 2 as having only one barrel for clarity of explanation. Mounting plate 25 has series of peripheral, outwardly extending, serrated teeth 31 each of which is aligned with a barrel 26. The serrated teeth 31 are configured to cooperate with a pawl 32 extending from the stock 11. The mounting plate 25 also has an annular array of L-shaped grooves 33 equal in number to the number of magazine barrels 26.

The gun 10 has a pressure chamber 35 adapted to receive and store a supply of air at elevated pressure levels and a pressure sensitive release valve 36 mounted within the pressure chamber 35. The pressure chamber 35 has an exit opening 37 therein. A spring biased sealing plate 38 is mounted within opening 37. The sealing plate 38 has a central bore 39 extending into an elongated bore 40 configured to overlay the mounting plate openings 28. It should be noted that the mounting plate openings 28 are positioned so that the sealing plate elongated bore 40 overlaps only one opening 28 at a time. A gasket 42 is mounted to the sealing plate 38 to ensure sealing engagement of the sealing plate with the mounting plate 25. The release valve 36 has a cylindrical manifold 45 and a cylindrical plunger 46 slidably mounted within manifold 45. Plunger 46 has a gasket 47 to ensure sealing engagement of the plunger about opening 37.

The release valve manifold 45 is pneumatically coupled to an actuator 50, by a pressure tube 51 extending therebetween the actuator 50 automatically and sequentially causes the actuation of the release valve 36. Actuator 50 includes an elongated manifold 52 having an upper opening 53 in fluid communication with pressure tube 51 and a lower opening 55 in fluid communication with another pressure tube 56 extending from the pressure tank 15 and positioned so as to be pinchably closed by spring biased trigger 13. A piston 58 is movably mounted within actuator manifold 52. Piston 58 has a top seal 59 and a bottom seal 60. The actuator 50 also has a pressure cylinder 62 having a vent 61 adjacent its top end. Pressure cylinder 62 is coupled in fluid communication with pressure chamber 35 by a pressure tube 63. A piston 64, having an elongated piston rod 65, is mounted within the actuator pressure cylinder 62 for reciprocal movement therein between a low pressure position shown in FIGS. 2 and 3 and a high pressure position shown in FIG. 4. A coil spring 67 mounted about piston rod 65 biases the piston 64 towards its low pressure position. Piston rod 65 is coupled to piston 58 by an over center torsion spring 68, such as that made by Barnes Group Incorporated of Corry, Pa. under model number T038180218-R. An indexing finger 69, mounted to an end of the piston rod 65, is configured to sequentially engage and ride within each magazine L-shaped groove 33.

In use, an operator actuates the pump to pressurize a supply of air by grasping the handle 22 and reciprocating the cylinder rod 21 back and forth within the cylinder 20. Pressurized air is passed through pressure tube 16 into the pressure tank 15. Manual actuation of the trigger 13 moves the trigger to a position wherein it unpinches pressure tube 56 so as to allow pressurized air within the pressure tank 15 to pass through pressure tube 56 into actuator manifold 52 between the top and bottom seals 59 and 60. The pressurized air then passes out of lower opening 55 and through pressure tube 51 into release valve manifold 45.

Figure 3:
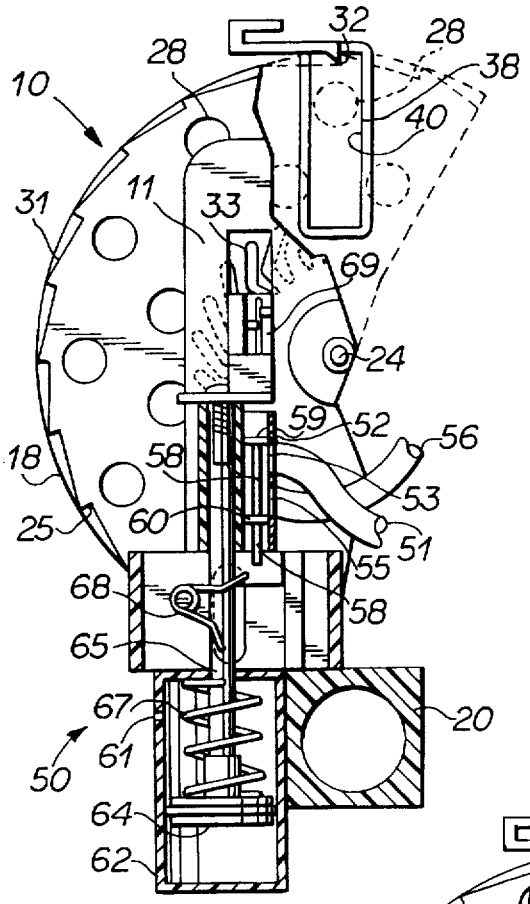
FIGS. 3–5 are a sequence of views showing a portion of the air gun of FIG. 1, which show in sequence, the actuation of an actuator which indexes a magazine and controls a release valve.
Figure 4:
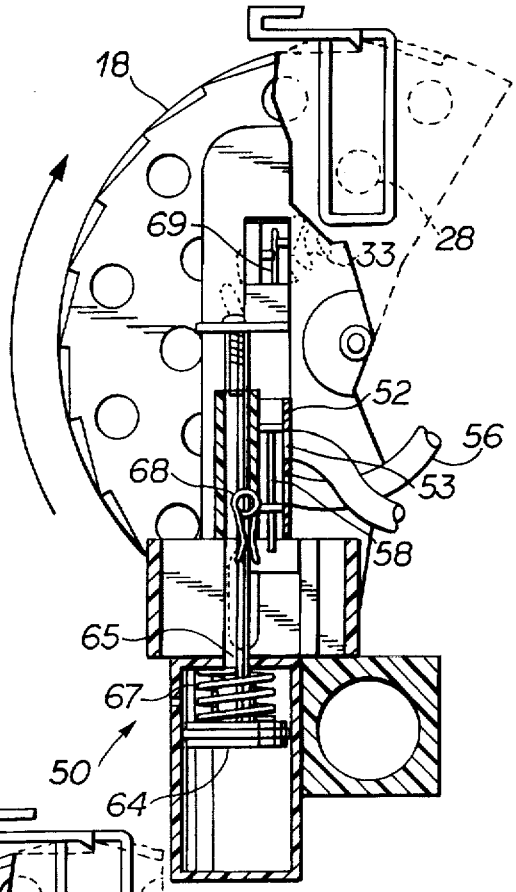
Figure 5:
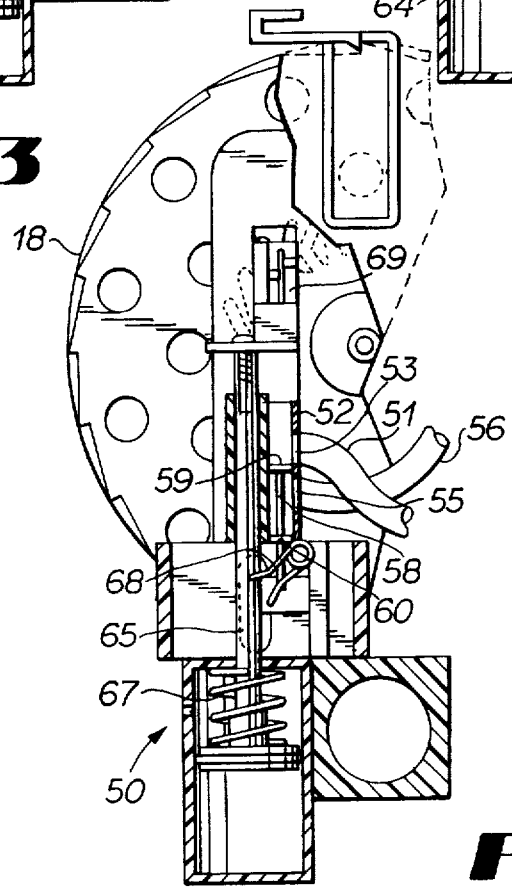
Figure 6:
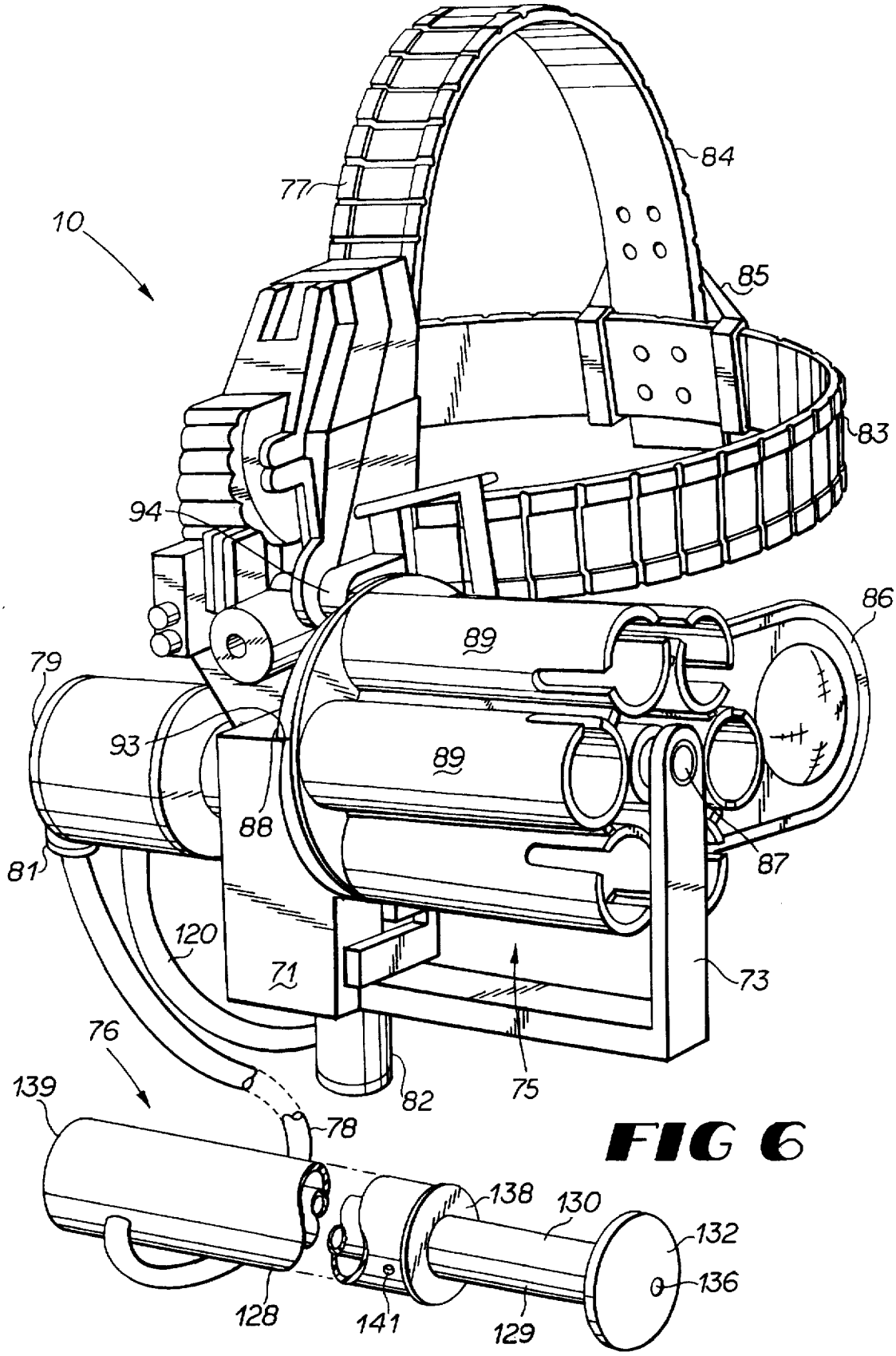
FIG. 6 is a perspective view of a rapid fire compressed air gun embodying principles of the present invention in another preferred form.

The pressurized air within the release valve manifold 45 causes the plunger 46 to move to a forward position sealing the opening 37. Pressurized air then flows between the plunger 46 and the release valve manifold 45 so as to pressurize the pressure chamber 35. A portion of the pressurized air within pressure chamber 35 passes through pressure tube 63 into the actuator pressure cylinder 62. With increased pressure within pressure cylinder 62 the piston 64 is forced upwards against the biasing force of coil spring 67, i.e. the piston 64 is moved from its low pressure position shown in FIG. 3 to its high pressure position shown in FIG. 4. As shown in FIG. 4, upward movement of the piston rod 65 causes compression of torsion spring 68 and the finger 69 to ride up within a mounting plate groove 33 thereby causing clockwise rotation of the magazine 18. All references herein to downward and upward directions is for purposes of clarity in reference to the drawings and is not meant to indicate gravity sensitivity. Upon reaching the apex of the movement of piston rod 65 the torsion spring 68 decompresses thereby forcing piston 58 downward, as shown in FIG. 5. Downward movement of piston 58 causes the top seal 59 to be positioned between upper opening 53 and lower opening 55. This positioning of the piston 58 isolates manifold lower opening 55 to prevent escape of pressurized air from pressure tank 15. This positioning of the top seal 59 also allows pressurized air within pressure tube 51 to escape to ambience through the top of actuator manifold 52. The release of air pressure causes the plunger 46 to move to a rearward position unsealing opening 37. With the unsealing of opening 37 pressurized air within pressure chamber 35 flows through opening 37, into the central and elongated bores 39 and 40 of sealing plate 38, and into the launch tube 27 through mounting plate opening 28. Pressurized air within launch tube 27 propels the projectile out of the magazine barrel 26 and through gun barrel 12. The actuation of this type of release valve is described in more detail in U.S. Pat. No. 4,159,705.

Upon the release of pressurized air from pressure chamber 35 the pressurized air within pressure cylinder 62 is released through pressure tube 63 back into pressure chamber 35. The release of air from pressure cylinder 62 causes the piston 64 be spring biased by coil spring 67 back downward to its low pressure position. The downward movement of piston 64 retracts the indexing finger 69 from within a mounting plate groove 33 and positions the finger in register with the following mounting plate groove 33. The low pressure positioning of piston 64 causes the torsion spring 68 to bias piston 58 upwards to its initial position with the top and bottom seals 59 and 60 straddling upper and lower openings 53 and 55, as shown in FIG. 3. This repositioning of piston 58 once again causes pressurized air within pressure tank 15 to flow through pressure tube 56 into actuator manifold 52, thereby completing a firing cycle. The firing and indexing cycle just describe may continue in rapid sequence so long as the trigger is maintained in a position allowing the flow of pressurized air through pressure tube 56 and the pressure tank continues to contains a minimal level of pressurized air sufficient to overcome the biasing force of springs 67 and 68, i.e. the release valve is automatically actuated by actuator 50 and the indexing of magazine 18 continues so long as the trigger is pulled open and the pressure tank contains pressurized air above a level to overcome springs 67 and 68. Should the pressure level within pressure tank 15 reach the minimal level the operator simply actuates the manual air pump 14 so as to once again elevate the pressure within the pressure tank.

As described, the gun may be used in a fully automatic manner such that with the trigger maintained in a pulled back, actuated position the gun fires a series of projectiles without stopping between each successive shot, similar to the action of a machine gun. However, should an operator wish to fire a single projectile, one need only to pull the trigger and quickly release it so that pressurized air does not continue to flow into the actuator 50. Operated in such a manner the gun will index the magazine and fire a projectile with each actuation of the trigger, again, so long as the pressure tank contains air pressurized above the minimal level and the trigger is quickly released.

It should be noted that pawl 32 engages teeth 31 to prevent rotation of the magazine in a direction opposite to its indexing direction, i.e. to prevent counterclockwise rotation in FIG. 3. This prevents the firing of pressurized air into a just emptied barrel and damage to the indexing finger. It should also be noted that since the pneumatic system is closed, once the gun is initially pressurized it is maintained under at least the minimal pressure level. Thus, the gun has the capability of firing projectiles in a rapid sequence of shots one after another. Yet, the gun may also fire a sequence of single shots without having to be pumped between each successive shot.

Referring next to FIGS. 6–9, a compressed air gun 70 in another preferred form is shown. Here, the air gun 70 has a housing 71 having a support plate 72 and an L-shaped support arm 73, a magazine 75 rotationally mounted to the housing 71, a remote manual hand air pump 76, and a harness 77 secured to housing 71 and configured to be supported upon the head of a person. The gun 70 has a pressure chamber 79 adapted to receive and store a supply of air at elevated pressure levels and a pressure actuatable release valve 80 mounted within the pressure chamber 79. A control valve 81 is mounted in fluid communication with release valve 80 and is coupled in fluid communication with pump 76 by a pressure tube 78 extending therebetween. Pressure chamber 79 is pneumatically coupled to a pneumatic indexer 82 which in turn is coupled to magazine 75 for rotational movement thereof.

The head harness 77 has a generally circular base strap 83 and a inverted U-shaped, adjustable top strap 84 secured to the base strap 83 by a buckle 85. The head harness 77 also has a clear eye sight 86 configured to be positioned over the eye of a person. The top strap 84 and base strap 83 may be made of a soft, flexible plastic which can conform to the person's head.

Figure 9:
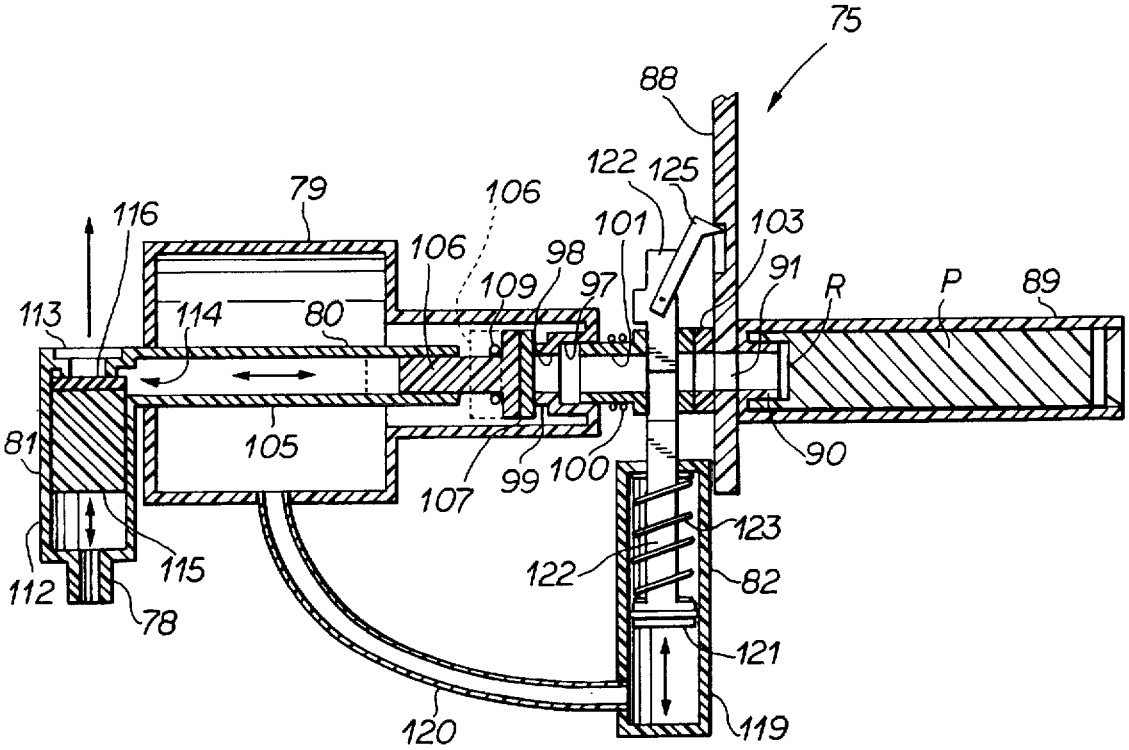
FIG. 9 is a side view, shown in partial cross-section, of interior components of the air gun of FIG. 6 and a projectile positioned within the barrel of the gun.

The magazine 75 has a central pivot rod 87 fixedly mounted to a disk-shaped mounting plate 88 and an annular array of projectile barrels or launch tubes 89 extending from the mounting plate 88 in a generally concentric circle about pivot rod 87. Pivot rod 87 is rotationally mounted at one end to support arm 73 and rotationally mounted at its opposite end to support plate 72. Each barrel 89 has a launch tube 90 therein aligned with an opening 91 which extends through the mounting plate 88. The interior diameter of barrel 89 is configured to releasably hold a projectile P with the launch tube 90 configured to be received within a recess R in the rear of the projectile. The magazine is shown in FIG. 9 as having only one barrel 89 for clarity of explanation. Mounting plate 88 has series of peripheral notches 93 each of which is aligned with a barrel 89. The notches 93 are configured to cooperate with a pawl 94 extending from the housing 71. Mounting plate 88 also has an annular array of L-shaped grooves 95 oriented about pivot rod 87 which are equal in number to the number of magazine barrels 89.

The pressure chamber 79 has a recess 97 having an air exit opening 98 therein defined by an inwardly extending annular flange 99. A spring biased sealing plate 100 is mounted within recess 97. The sealing plate 100 has a central bore 101 configured to overlay the mounting plate openings 91 of the magazine. It should be noted that the mounting plate openings 91 are positioned so that the sealing plate bore 101 overlaps only one opening 91 at a time. A gasket 103 is mounted to the sealing plate 100 to ensure sealing engagement with the mounting plate 88. The release valve 80 has a cylindrical manifold 105 and a cylindrical plunger 106 slidably mounted within the manifold 105. Plunger 106 has a gasket 107 to ensure sealing engagement of the plunger 106 about opening 98 with the plunger in a sealing position shown in FIG. 9, and a O-ring type seal 109 to ensure sealing engagement of the plunger 106 against manifold flange 99 with the plunger in a released position shown in phantom lines in FIG. 9.

The control valve 81 has an elongated cylindrical manifold 112 having a top vent opening 113 to ambience, a side opening 114 in fluid communication with release valve manifold 105, and a cylindrical plunger 115 slidably mounted within manifold 112. Plunger 115 has a gasket 116 to ensure sealing engagement of the plunger about vent opening 113 with the plunger in a pressurized position shown in FIGS. 7 and 9.

The indexer 82 has a pressure cylinder 119 coupled in fluid communication with pressure chamber 79 by a pressure tube 120. A piston 121, having an elongated piston rod 122, is mounted within the indexer pressure cylinder 119 for reciprocal movement therein between a low pressure position shown in FIG. 8 and a high pressure position shown in FIGS. 7 and 9. A coil spring 123 is mounted about piston rod 122 so as to bias the piston 121 towards its low pressure position. A spring biased indexing finger 125 is pivotably mounted to piston rod 125. Indexing finger 125 is configured to sequentially engage and ride within each magazine groove 95 as the piston rod is moved upward and to disengage the groove as the piston rod is moved downward. All references herein to downward and upward directions is for purposes of clarity in reference to the drawings and is not meant to indicate gravity sensitivity.

The air pump 76 includes an elongated cylinder 128 and a plunger 129 telescopically mounted for reciprocal movement within the cylinder 128. Plunger 129 has a tubular shaft 130 with an enlarged sealing end 131 and a handle 132 opposite the sealing end 131. Sealing end 131 has an O-ring type seal 133 with an opening 134 therethrough, and a conventional check valve 135 mounted within opening 134. Check valve 35 is oriented to allow air to pass from the interior of cylinder 128 through opening 134 into the interior of shaft 130 and to prevent air from passing through opening 134 in the opposite direction. Handle 132 has a vent 136 therethrough which allows air to pass from ambience into the interior of shaft 130.

Pump cylinder 128 has an open end 138 through which plunger 129 extends and a closed end 139. The pump cylinder 128 also has a port 140 in fluid communication with pressure tube 78 and a vent 141 adjacent open end 138 which is open to ambience. Port 140 is spaced from closed end 139 so as to allow seal 133 of plunger 129 to be moved past the port 140 to a position closely adjacent to the closed end 139, as shown in FIG. 8.

In use, a person dons the gun by securing the head harness 77 to his head with the magazine 75 to one side. The person then actuates the pump 76 by grasping the pump handle 132 and forcing the pump plunger 129 through cylinder 128 towards port 140 thereby pressurizing air within the cylinder. Thus, the plunger 129 is moved from a first position shown in phantom lines in FIG. 7 to generally a second position shown in FIG. 7. The pressurized air passes through port 140 into pressure tube 78 where it then passes through control valve 81. The increase in air pressure within the control valve manifold 112 forces the control valve plunger 115 to move to an upper, pressurized position sealing vent opening 113, as shown in FIG. 9. The pressurized air then passes about plunger 115 and through side opening 114 into the release valve manifold 105. The increase in air pressure within the release valve manifold 105 forces the control valve plunger 106 to move to a forward, pressurized position sealing opening 98, as shown in FIG. 9. The pressurized air then flows between the release valve plunger 106 and the release valve manifold 105 into pressure chamber 79.

A portion of the pressurized air within pressure chamber 79 passes through pressure tube 120 into the indexer pressure cylinder 119. With increased pressure within pressure cylinder 119 the indexer piston 121 is forced upwards against the biasing force of coil spring 123, i.e. the indexer piston 121 is moved from its low pressure position shown in FIG. 8 to its high pressure position shown in FIGS. 7 and 9. As shown in FIG. 9, upward movement of the piston rod 122 causes the finger 125 to ride up within a mounting plate groove 95 to cause counter-clockwise rotation of the magazine 75 as indicated by arrows in FIGS. 7 and 8.

Figure 8:
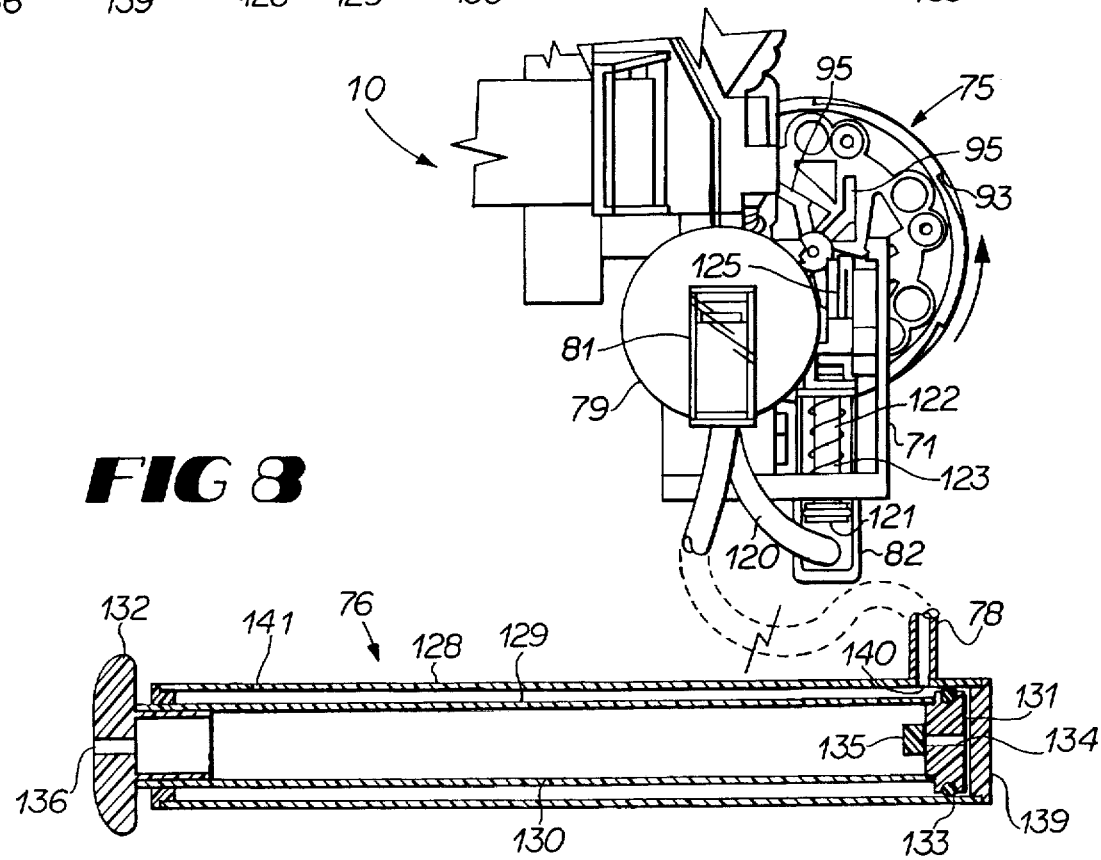
FIG. 8 is a rear view of portions of the air gun of FIG. 6 with the pump shown in side view for clarity of explanation.

With continued movement of the pump plunger 129 within pump cylinder 128 the seal 133 passes pump cylinder port 140, as shown in FIG. 8. With the plunger seal 133 in this position pressurized air within pressure tube 78 is released back into pump cylinder 128 behind seal 133 and then to ambience through vent 141. The reentry of pressurized air into the pump cylinder 128 from pressure tube 78 causes the control valve plunger 115 to move to a downward position unsealing vent opening 113, as shown in FIG. 8. Thus, the decrease in air pressure within the pressure tube 78 and control valve manifold 112 triggers the actuation of control valve 81 to its open configuration. The actuation of the control valve to its open, downward position causes a release of pressurized air from within release valve manifold 105 through the control valve side opening 113 and then through vent opening 113 to ambience. This decrease in pressure causes release valve plunger 106 to move to a rearward position unsealing opening 98, as shown in phantom lines in FIG. 9. The position of the plunger 106 also causes and the O-ring to abut manifold 105 to seal the path between the manifold 105 and plunger 106. With the unsealing of opening 98 pressurized air within pressure chamber 79 rapidly flows through opening 98, through sealing plate bore 101, through magazine mounting plate opening 91, and into launch tube 90 in register with the sealing plate 100 where it propels the projectile P from barrel 89. Operation of this type of release valve is described in more detail in U.S. Pat. No. 4,159,705.

Upon the release of pressurized air from pressure chamber 79 the pressurized air within indexer pressure cylinder 119 is conveyed through pressure tube 120 back into pressure chamber 79. This release of pressurized air from indexer pressure cylinder 119 causes the indexer piston 121 to be spring biased by coil spring 123 back downward to its low pressure position. The downward movement of piston 121 pivotally retracts the indexing finger 125 from mounting plate groove 95 and positions the finger in register with the following mounting plate groove.

The pump plunger 129 may then be manually drawn back to its initial position to pressurize and fire the gun again. The drawing back of the pump plunger 129 does not create a vacuum within pump cylinder 128 since replenishment air may be drawn through vent 136 into the plunger handle 132, through the interior of shaft 130, and through check valve 135 into cylinder 128. Air between the pump cylinder 128 and the plunger 129 behind seal 134 is expelled from cylinder 128 through vent 141.

Figure 7:
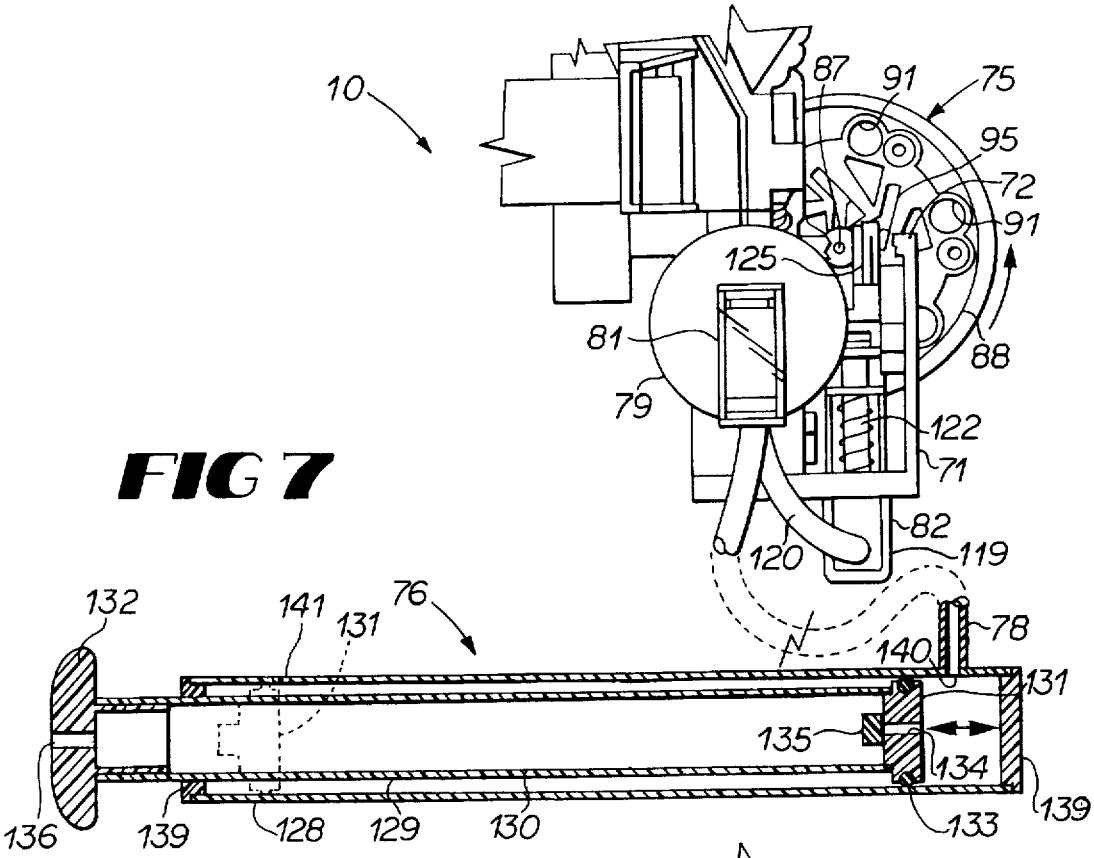
FIG. 7 is a rear view of portions of the air gun of FIG. 6 with the pump shown in side view for clarity of explanation.

It should be noted that pawl 94 engages notches 93 to prevent rotation of the magazine 75 in a direction opposite to its indexing direction, i.e. to prevent clockwise rotation of the magazine with reference to FIGS. 7 and 8. This prevents the firing of pressurized air into a previously emptied barrel and damage to the indexing finger 125.

As an alternative, gun 70 may also be constructed without control valve 81. The need for the control valve is dependent upon the length and interior diameter of pressure tube 78, i.e. the volume of air contained within the pressure tube. For a pressure tube 78 having a small interior volume the release of air therefrom causes rapid actuation of release valve 80. Conversely, with a pressure tube 78 containing a large volume of air therein the release of air therefrom may be inadequate to actuate the release valve properly. Thus, with pressure tubes having a large volume therein a control valve 81 is coupled to the release valve 80 to ensure rapid decompression within release valve manifold 105 to actuate the release valve. The gun may also be constructed without the inner launch tube 90 within the barrel 89. Here, the pressurized air expelled from pressure chamber 79 is directed into barrel 89 behind the projectile. This design however is not preferred as it does not concentrate the burst of pressurized air for optimal efficiency and performance. Lastly, it should be understood that the magazine and indexer of FIGS. 6–9 may also be adapted to a hand held gun of conventional design.

With the air gun of this construction a child may aim the gun simply by facing the intended target and manually actuating the hand pump. Because of the elongated, flexible pressure tube 78 the pump may be manipulated substantially independently of and without effecting the air of the launch tube. Thus, the gun is of an unconventional design to interest children yet is capable of being easily aimed and fired. Also, the child may fire several shots sequentially without having to reload between each successive shot.

While this invention has been described in detail with particular reference to the preferred embodiments thereof, it should be understood that many modifications, additions and deletions, in addition to those expressly recited, may be made thereto without departure from the spirit and scope of invention as set forth in the following claims.

We claim:

1. A compressed air toy gun for firing projectiles comprising:

launch tube means for holding, aiming and launching projectiles;

head harness means for supporting said launch tube means adjacent the head of a person;

hand pump means for manually compressing air; and flexible conduit means for conveying compressed air from said hand pump means to said launch tube means as said hand pump means is manipulated by the person and oriented substantially independently of and without effecting the aim of the launch tube means.

2. The compressed air toy gun of claim 1 further comprising a pressure chamber in fluid communication with said hand pump means and said launch tube means, and a release valve for controlling the flow of compressed air from said pressure chamber into said launch tube means.

3. The compressed air toy gun of claim 1 wherein said launch tube means comprises a magazine having a plurality of launch tubes, and pneumatic indexing means in fluid communication with said hand pump means for sequentially positioning said launch tubes of said magazine for firing.

4. The compressed air toy gun of claim 3 wherein said pneumatic indexing means includes a manifold in fluid communication with said pump means, a piston positioned within said manifold for reciprocal movement between a first position and a second position, biasing means for biasing said piston toward said first position, and wherein said flexible conduit means includes a conduit for conveying pressurized air to said manifold for use in pneumatically biasing said piston toward said second position, and coupling means for coupling said piston to said magazine.

5. The compressed air toy gun of claim 4 wherein said coupling means includes an array of grooves upon said magazine and a finger mounted to said piston configured to ride within said grooves.

6. The compressed air toy gun of claim 2 further comprising a control valve in fluid communication with said release valve and said pump means for controlling the actuation of said release valve.

7. A compressed air toy gun comprising, a magazine in which a plurality of projectiles may be loaded; pump means for compressing air; pneumatic indexing means for sequentially positioning projectiles in said magazine for firing; triggering means for sequentially triggering the release of compressed air to said magazine for firing the projectiles; and means for conveying compressed air from said pump means to said pneumatic indexing means and to said magazine in both sequentially positioning and firing the projectiles, said pneumatic indexing means includes a manifold in fluid communication with said pump means, a piston positioned within said manifold for reciprocal movement between a first position and a second position, biasing means for biasing said piston toward said first position, and wherein said conduit means includes a conduit for conveying pressurized air from said pump means to said manifold for use in pneumatically biasing said piston toward said second position, and coupling means for coupling said piston to said magazine.

8. A compressed air toy gun of claim 7 wherein said coupling means include an array of grooves upon said magazine and a finger mounted to said piston configured to ride within said grooves.

9. A compressed air toy gun comprising, a magazine in which a plurality of projectiles may be loaded; pump means for compressing air; pneumatic indexing means for sequentially positioning projectiles in said magazine for firing; triggering means for sequentially triggering the release of compressed air to said magazine for firing the projectiles; means for conveying compressed air from said pump means to said pneumatic indexing means and to said magazine in both sequentially positioning and firing the projectiles; and a pressure chamber in fluid communication with said pump means and said launch tube, and said triggering means includes a release valve for controlling the flow of compressed air from said pressure chamber into said launch tube, and said pneumatic indexing means includes a manifold in fluid communication with said pressure chamber, a piston positioned within said manifold for reciprocal movement between a first position and a second position, biasing means for biasing said piston toward said first position, and wherein said conveying means includes a conduit for conveying pressurized air from said pressure chamber to said manifold for use in pneumatically biasing said piston toward said second position, and coupling means for coupling said piston to said magazine.

10. The compressed air toy gun of claim 9 wherein said coupling means includes an array of grooves upon said magazine and a finger mounted to said piston configured to ride within said grooves.

11. A compressed air toy gun comprising, a magazine in which a plurality of projectiles may be loaded; pump means for compressing air; pneumatic indexing means for sequentially positioning projectiles in said magazine for firing; triggering means for sequentially triggering the release of compressed air to said magazine for firing the projectiles; means for conveying compressed air from said pump means to said pneumatic indexing means and to said magazine in both sequentially positioning and firing the projectiles; and a pressure chamber in fluid communication with said pump means and said launch tube, said triggering means includes a release valve for controlling the flow of compressed air from said pressure chamber into said launch tube and a control valve in fluid communication with said release valve and said pump means for controlling the actuation of said release valve.

12. A compressed air toy gun comprising, a magazine in which a plurality of projectiles may be loaded; pump means for compressing air; pneumatic indexing means for sequentially positioning projectiles in said magazine for firing; triggering means for sequentially triggering the release of compressed air to said magazine for firing the projectiles; means for conveying compressed air from said pump means to said pneumatic indexing means and to said magazine in both sequentially positioning and firing the projectiles; and a harness configured to be mountable to the head of a person.

13. A compressed air toy gun comprising a magazine having a plurality of launch tubes each configured to hold a projectile; pump means for pressurizing air; a pressure chamber in fluid communication with said pump means adapted to contain pressurized air; a release valve in fluid communication with said pressure chamber and said magazine; pneumatic indexing means in fluid communication with said pump means and coupled to said magazine for sequentially positioning said magazine launch tubes in position for firing, and triggering means for controlling the actuation of said release valve, said pneumatic indexing means includes a manifold in fluid communication with said pump, a piston positioned within said manifold for reciprocal movement between a first position and a second position, biasing means for biasing said piston toward said first position, and coupling means for coupling said piston to said magazine, whereby pressurized air from the pump means is used to both actuate the pneumatic indexing means and to pressurize the pressure chamber for use in propelling projectiles from the magazine.

14. The compressed air toy gun of claim 13 wherein said coupling means includes an array of grooves upon said magazine and a finger mounted to said piston configured to ride within said grooves.

15. A compressed air toy gun comprising a magazine having a plurality of launch tubes each configured to hold a projectile; pump means for pressurizing air; a pressure chamber in fluid communication with said pump means adapted to contain pressurized air; a release valve in fluid communication with said pressure chamber and said magazine; pneumatic indexing means in fluid communication with said pump means and coupled to said magazine for sequentially positioning said magazine launch tubes in position for firing, and triggering means for controlling the actuation of said release valve, said triggering means includes a control valve in fluid communication with said release valve and said pump for controlling the actuation of said release valve, whereby pressurized air from the pump means is used to both actuate the pneumatic indexing means and to pressurize the pressure chamber for use in propelling projectiles from the magazine.

16. A compressed air toy gun comprising a magazine having a plurality of launch tubes each configured to hold a projectile; pump means for pressurizing air; a pressure chamber in fluid communication with said pump means adapted to contain pressurized air; a release valve in fluid communication with said pressure chamber and said magazine; pneumatic indexing means in fluid communication with said pump means and coupled to said magazine for sequentially positioning said magazine launch tubes in position for firing, triggering means for controlling the actuation of said release valve, and a harness configured to be worn on the head of a person, whereby pressurized air from the pump means is used to both actuate the pneumatic indexing means and to pressurize the pressure chamber for use in propelling projectiles from the magazine.

* * * * *